US007878949B2

(12) United States Patent
Chen

(10) Patent No.: US 7,878,949 B2
(45) **Date of Patent: *Feb. 1, 2011**

(54) STEPPER

(75) Inventor: Tsung-Jen Chen, Chiayi (TW)

(73) Assignee: Chin-Yu Tu, Chiayi (TW)

( * ) Notice: Subject to any disclaimer, the term of this patent is extended or adjusted under 35 U.S.C. 154(b) by 0 days.

This patent is subject to a terminal disclaimer.

(21) Appl. No.: 12/432,319

(22) Filed: Apr. 29, 2009

(65) Prior Publication Data

US 2009/0291809 A1 Nov. 26, 2009

(30) Foreign Application Priority Data

May 23, 2008 (TW) ..... 97208990 U

(51) Int. Cl.
*A63B 22/04* (2006.01)

(52) U.S. Cl. ..... 482/52

(58) Field of Classification Search ..... 482/51, 482/52, 53, 54, 70, 71, 148; D21/670; 434/253, 434/255; 601/29, 31, 34, 35
See application file for complete search history.

(56) References Cited

U.S. PATENT DOCUMENTS 6,955,634 B1 * 10/2005 Lat ..... 482/71
7,465,255 B2 * 12/2008 Chen ..... 482/53
7,637,849 B2 * 12/2009 Chen ..... 482/52
2005/0113215 A1 * 5/2005 Chuang ..... 482/52
2005/0124465 A1 * 6/2005 Chen ..... 482/52
2005/0239606 A1 * 10/2005 Lin ..... 482/52
2007/0142182 A1 * 6/2007 Yang et al. ..... 482/52
2007/0270284 A1 * 11/2007 Lin ..... 482/52
2008/0194387 A1 * 8/2008 Chuang ..... 482/52
2008/0207406 A1 * 8/2008 Tsai ..... 482/52
2009/0270229 A1 * 10/2009 Chen ..... 482/52
2009/0291808 A1 * 11/2009 Chen ..... 482/52

* cited by examiner

*Primary Examiner*—Loan Thanh
*Assistant Examiner*—Tam Nguyen
(74) *Attorney, Agent, or Firm*—Banger Shia

(57) ABSTRACT

A stepper includes a base, two axle units, two pedals and a coordinating unit. The base includes a post formed thereon. Each of the axle units includes an axle extended downwards from the post. Each of the pedals includes a pedal pivotally connected to the axle of a related one of the axle units. The coordinating unit includes a lever pivotally connected to the post and formed with two ends each in contact with a related one of the pedals so that one of the pedals is moved upwards and outwards while the other pedal is moved downwards and inwards.

6 Claims, 8 Drawing Sheets

STEPPER

FIELD OF INVENTION

The present invention relates to a stepper with which a user can exercise his or her legs, buttocks and waist.

BACKGROUND OF INVENTION

A conventional stepper includes two pedals that can be pivoted up and down about horizontal axles. The movement of the pedals is limited to vertical directions. Therefore, a user can only exercise his or her legs.

Another conventional stepper includes two pedals that can be pivoted about two inclined axles extended from a post. The inclined axles and the post form a Y-shaped structure. One of the pedals will be lifted and moved towards the post if the other pedal is trodden and moved away from the post, i.e., outwards. Therefore, a user is forced to twist his or her waist while exercising his or her legs by treading the pedals. The user uses a little energy to twist his or her waist because he or she easily keeps balance while moving the pedal downwards and outwards.

The present invention is therefore intended to obviate or at least alleviate the problems encountered in prior art.

SUMMARY OF INVENTION

It is the primary objective of the present invention to provide a stepper with which a user can exercise his waist, buttocks and legs at the same time.

To achieve the foregoing objective, the stepper includes a base, two axle units, two pedals and a coordinating unit. The base includes a post formed thereon. Each of the axle units includes an axle extended downwards from the post. Each of the pedals includes a pedal pivotally connected to the axle of a related one of the axle units. The coordinating unit includes a lever pivotally connected to the post formed with two ends each in contact with a related one of the pedals so that one of the pedals is moved upwards and outwards while the other pedal is moved downwards and inwards.

Other objectives, advantages and features of the present invention will be apparent from the following description referring to the attached drawings.

BRIEF DESCRIPTION OF DRAWINGS

The present invention will be described via the detailed illustration of six embodiments referring to the drawings.

DETAILED DESCRIPTION OF EMBODIMENTS

Figure 1:
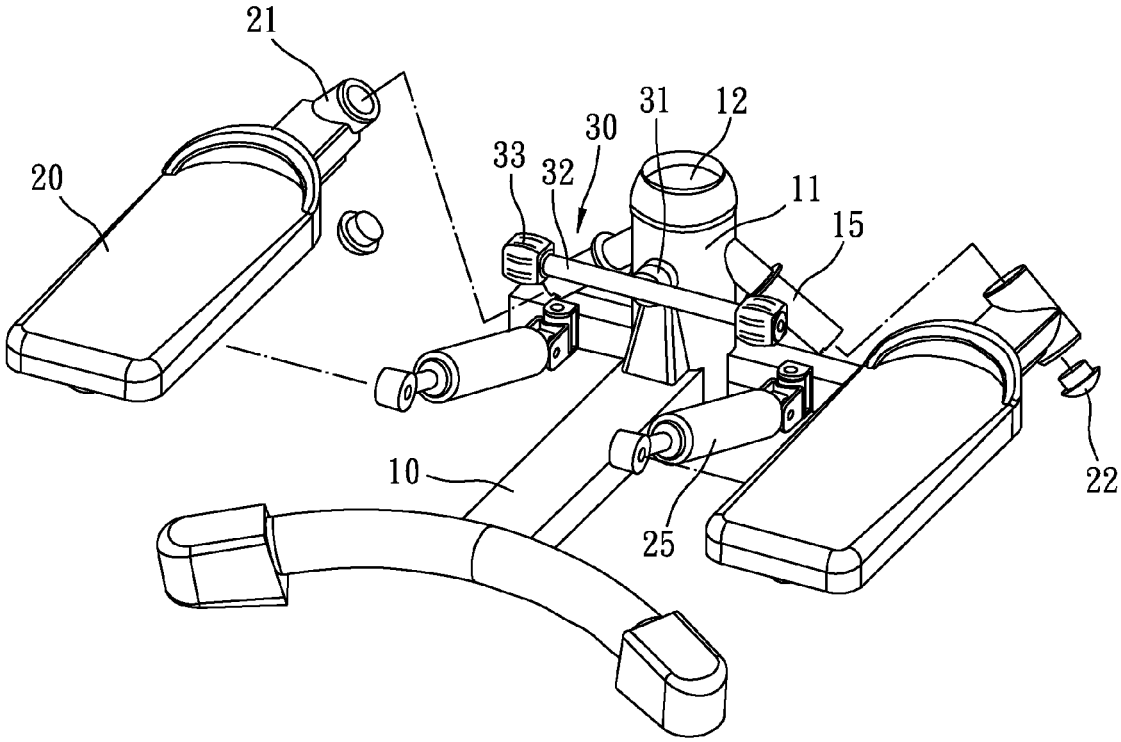
FIG. 1 is an exploded view of a stepper according to the first embodiment of the present invention.
Figure 2:
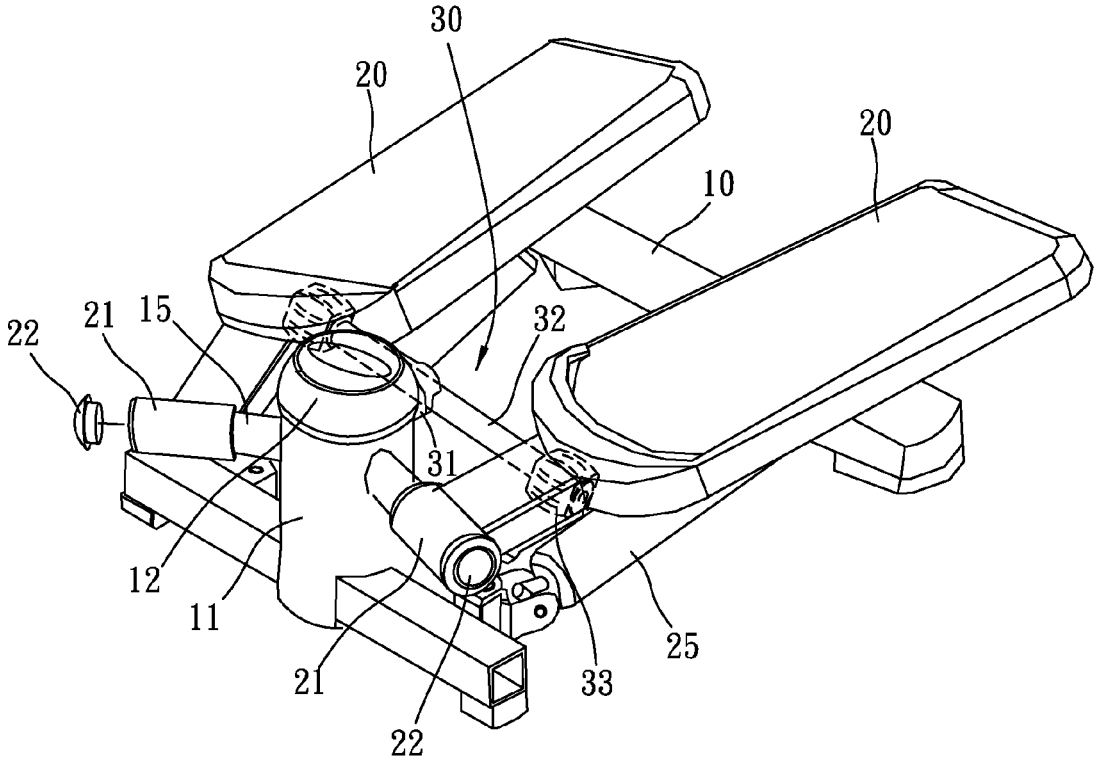
FIG. 2 is a perspective view of the stepper shown in FIG. 1.

Referring to FIGS. 1 and 2, a stepper includes a base 10, two pedals 20, a coordinating unit 30 and two impeding elements 25 according to a first embodiment of the present invention. The base 10 includes a post 11 formed on an upper side thereof and two axles 15 extended downwards from the post 11. Each of the axles 15 includes a fixed end on the post 11 and a free end opposite to the fixed end. The free end of each of the axles 15 is located lower than the fixed end. A controller 12 is provided at an upper end of the post 11. A handle may be provided on the post 11.

Each of the pedals 20 is connected to a sleeve 21 that is pivotally provided on a related one of the axles 15. A restraining element 22 is attached to the free end of each of the axles 15 to restrain a related one of the sleeves 21. The restraining element 22 may be a plug, clip or pin.

The coordinating unit 30 includes an axle 31 pivotally connected to the post 11 and a lever 32 formed with a center connected to the axle 31 and two ends each for contact with a related one of the pedals 20. Thus, the pedals 20 are interconnected so that one of the pedals 20 will be moved upwards and outwards while the other pedal 20 is moved downwards and inwards. A cushion 33 is attached to each of the ends of the lever 32 so that it is provided between the end of the lever 32 and the related pedal 20. The cushions 33 include a square profile.

Each of the impeding elements 25 is preferably a hydraulic cylinder including an end connected to the base 10 and another end connected to a related one of the pedals 20. Thus, each of the impeding elements 25 is used to exert impedance against the movement of a related one of the pedals 20. Each of the impeding elements 25 may be a pneumatic cylinder in another embodiment.

Figure 3:
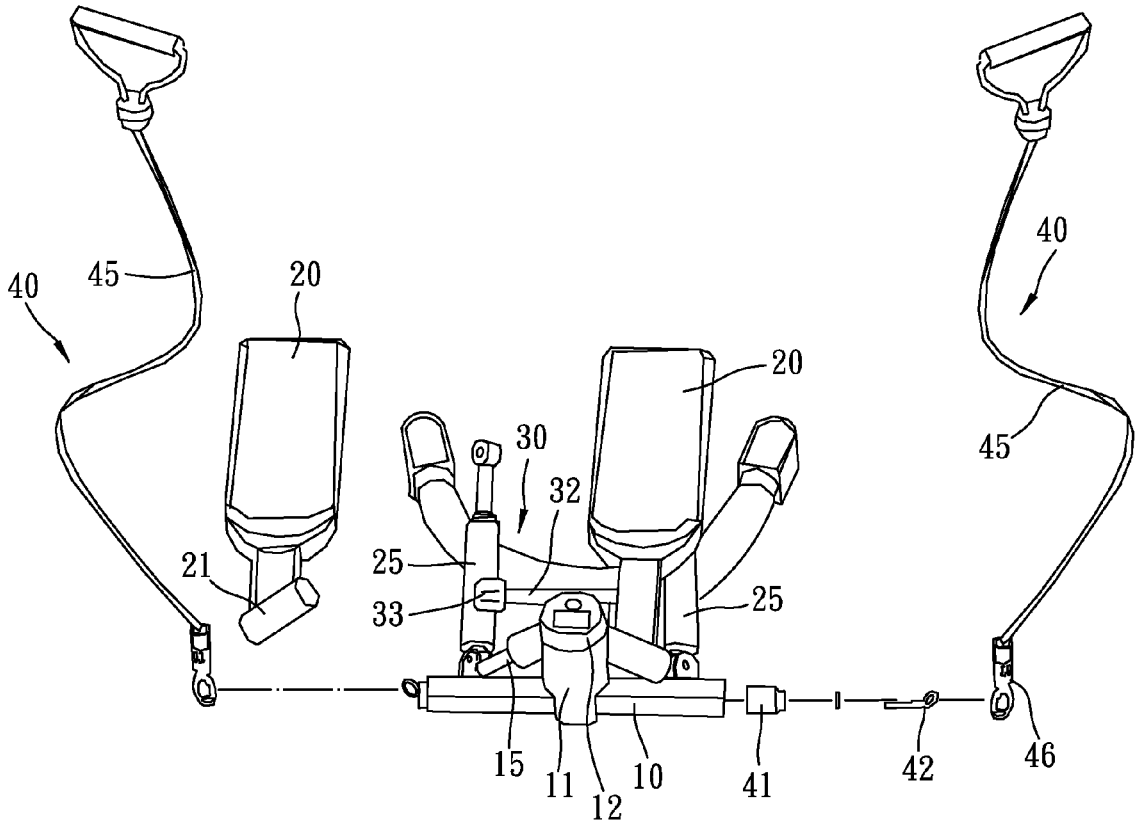
FIG. 3 is a top view of a stepper according to the second embodiment of the present invention.

Referring to FIG. 3, there is shown a stepper according to a second embodiment of the present invention. The second embodiment is like the first embodiment except including two arm-training units 40. Each of the arm-training units 40 includes an elastic string 45, a buckle 46 attached to the elastic string 45, a hook 42 for engagement with the buckle 46 and a fastener 41 for fastening the hook 42 to the base 10. The buckle 46 can be disengaged from the hook 42 so that the elastic string 45 can be disconnected from the base 10. A user can exercise his or her arms by pulling the elastic strings 45.

Figure 4:
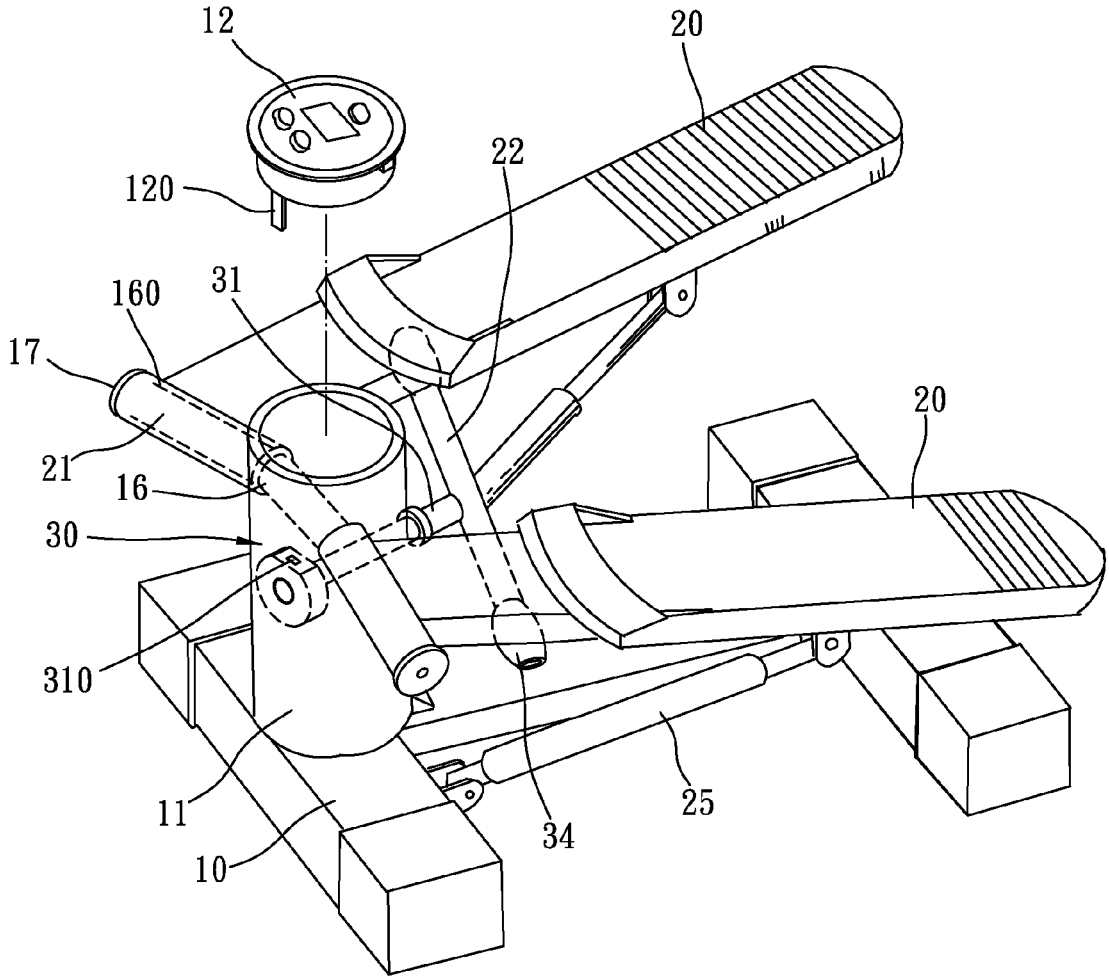
FIG. 4 is an exploded view of a stepper according to the third embodiment of the present invention.
Figure 5:
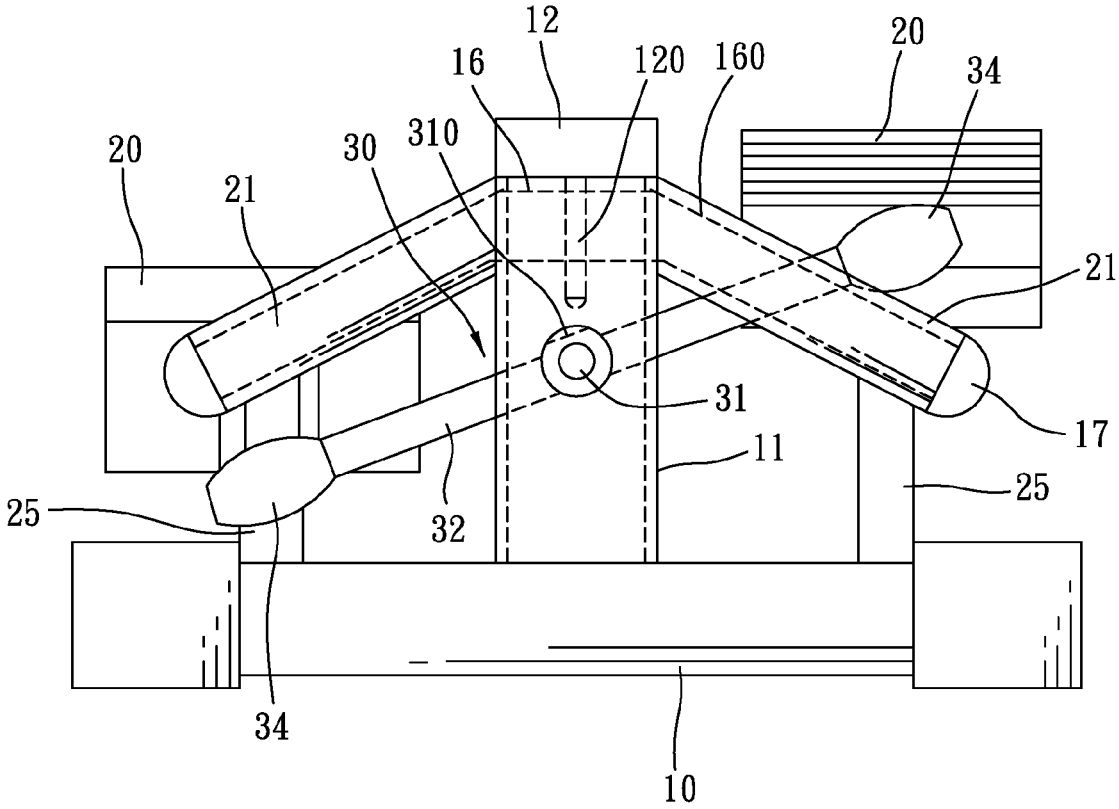
FIG. 5 is a front view of the stepper shown in FIG. 4.

Referring to FIGS. 4 and 5, there is shown a stepper according to a third embodiment of the present invention. The third embodiment is identical to the first embodiment except the following features. There is a bar 16 instead of the axles 15. The bar 16 is formed with a middle section disposed in the post 11 and two terminal sections 160 extended beyond the post 11. Like the axles 15, the terminal sections 160 of the bar 16 are directed downwards. Instead of the restraining element 22, a restraining element 17 is used to restrain each of the sleeves 21 on a related one of the terminal sections 160 of the bar 16. The coordinating unit 30 includes two cushions 34 instead of the cushions 33. The cushions 34 include a circular profile. A target 310 is attached to the axle 31. A sensor 120 is extended from the controller 12. Whenever the sensor 120 is moved to or near the target 310, a signal is generated to the controller 12 for counting.

Figure 6:
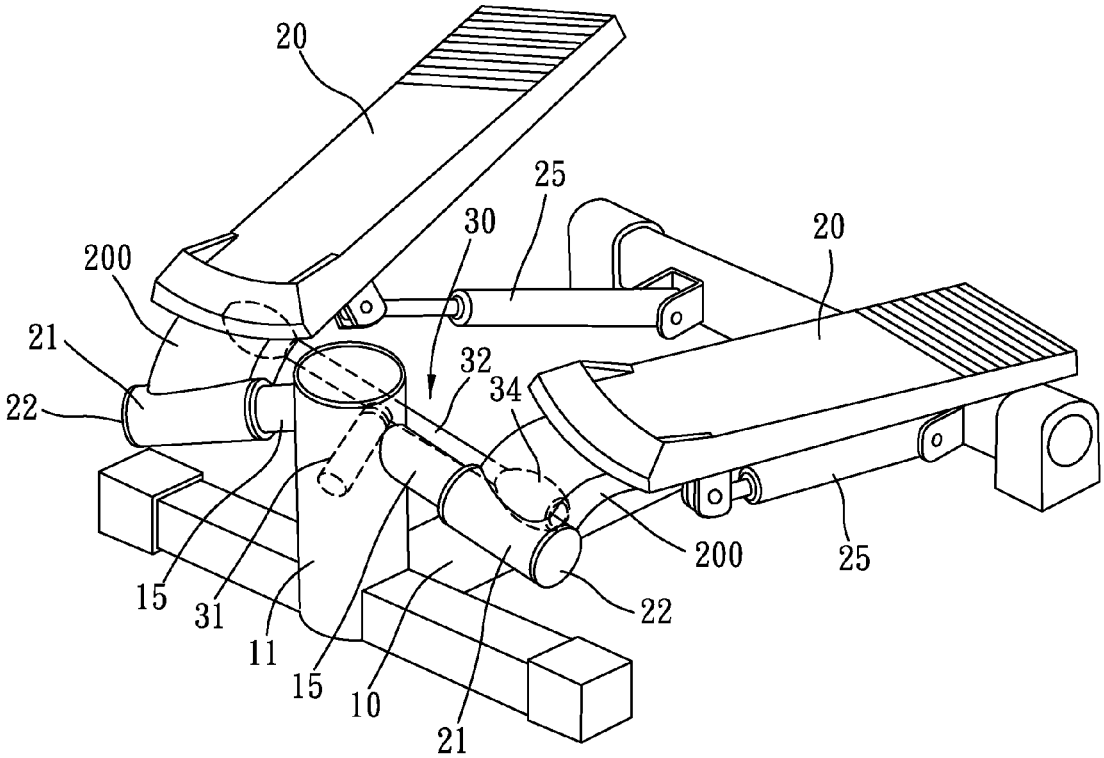
FIG. 6 is a perspective view of a stepper according to the fourth embodiment of the present invention.

Referring to FIG. 6, there is shown a stepper according to a fourth embodiment of the present invention. The fourth embodiment is like the first embodiment except the following features. There are provided two cushions 34 instead of the cushions 33. Each of the pedals 20 includes an arched section 200 for contact with a related one of the cushions 34.

Figure 7:
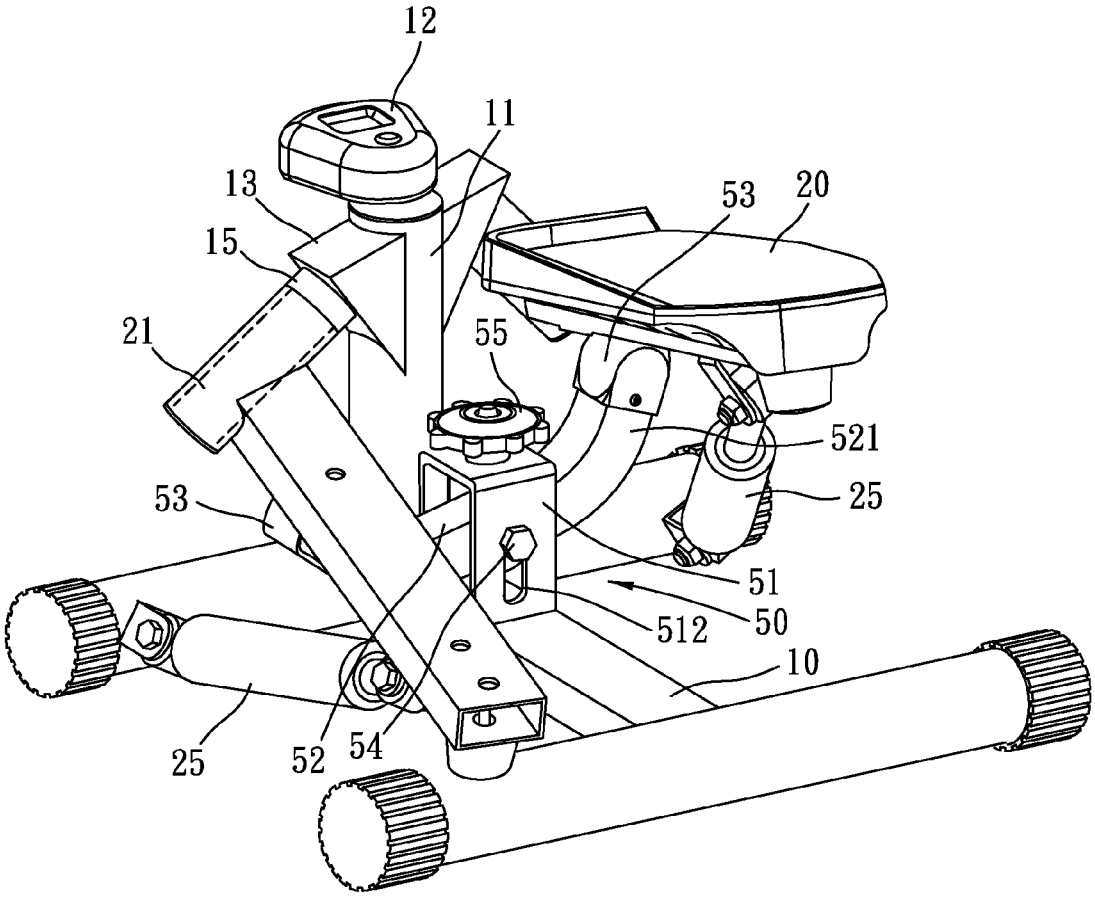
FIG. 7 is a perspective view of a stepper according to the fifth embodiment of the present invention.

Referring to FIG. 7, there is shown a stepper according to a fifth embodiment of the present invention. The fifth embodiment is like the first embodiment except the following features. There are two triangular blocks 13 attached to the post 11. Each of the axles 15 is attached to a related one of the triangular blocks 13. There is a coordinating unit 50 instead of the coordinating unit 30. The coordinating unit 50 includes a frame 51, a lever 52, two cushions 53, a fastener 54 and an adjusting element 55. The frame 51 is attached to the base 10 and formed with a slot 512. The lever 52 includes two arched terminal sections 521 each wrapped with a related one of the cushions 53. The lever 52 is pivotally connected to the frame 51 with the fastener 54, which is inserted through and movable along the slot 512. The adjusting element 55 is inserted though the frame 51 and connected to the lever 52 so that the adjusting element 55 is operable to vertically move the lever 52. Thus, the stroke of the movement of the pedals 20 is adjusted.

Figure 8:
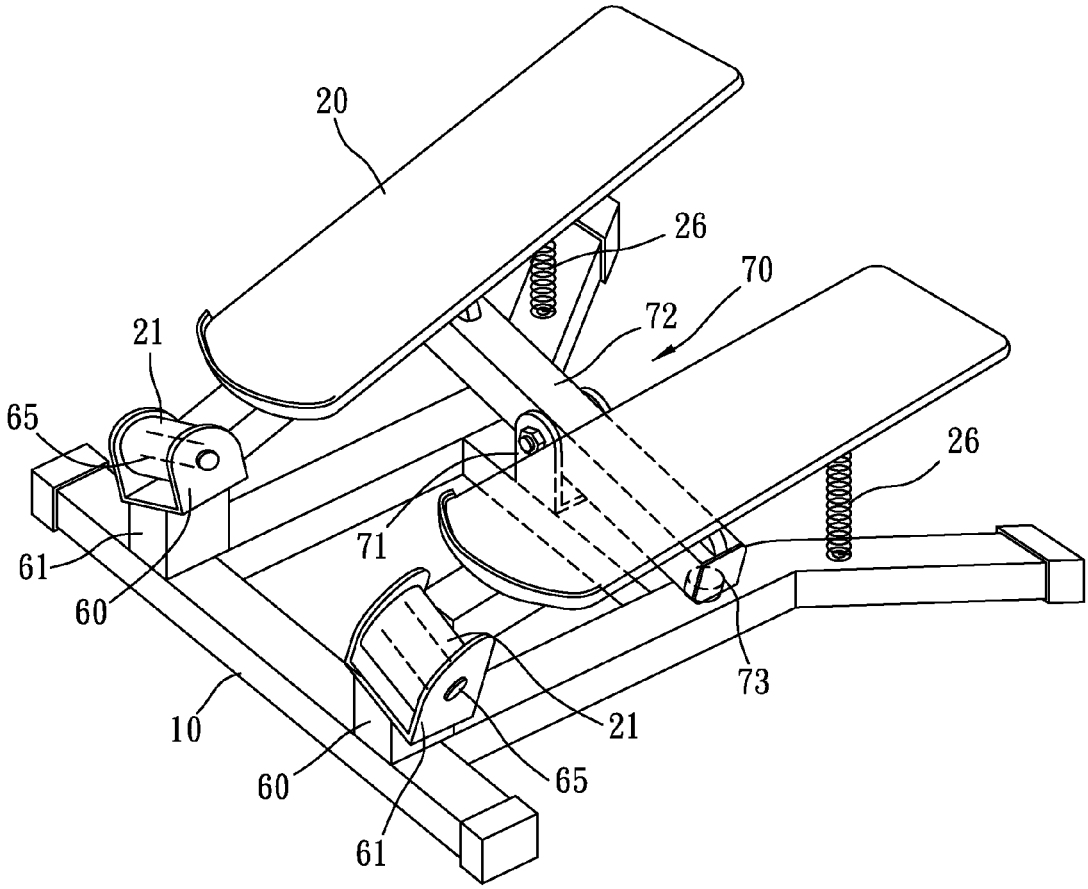
FIG. 8 is a perspective view of a stepper according to the sixth embodiment of the present invention.

Referring to FIG. 8, there is shown a stepper according to a sixth embodiment of the present invention. The sixth embodiment is like the first embodiment except the following features. There are two blocks 61 instead of the post 11. Each of the blocks 61 includes an inclined upper side on which a pair of ears 61 is provided. An axle 65 is provided on each of the pairs of ears 61. There is a coordinating unit 70 instead of the coordinating unit 30. The coordinating unit 70 includes a pair of ears 71 provided on the base 10 and a lever 72 pivotally supported on the pair of ears 71. Two pads 73 are attached to a lower side of the lever 72. Two impeding elements 26 are used instead of the impeding elements 25. The impeding elements 26 are springs.

The present invention has been described via the detailed illustration of the embodiments. Those skilled in the art can derive variations from the embodiments without departing from the scope of the present invention. Therefore, the embodiments shall not limit the scope of the present invention defined in the claims.

The invention claimed is:

1. A stepper comprising:

a base having an upright post;

two axles provided on the post wherein the axles extend laterally downwards as they extend away from each other on opposite flanks of the post;

two pedals each pivotally supported on a related one of the axles so that each of the pedals is moved inward as it is moved downward and each of the pedals is moved outward as it is moved upward;

two impeding elements each provided between the base and a related one of the pedals; and a coordinating unit comprising a lever pivotally supported on a rear portion of the post and formed with two cushioned ends each for contact with a bottom portion of a related one of the pedals so that as one of the pedals is moved upwards and outwards the other pedal is moved downwards and inwards.

2. The stepper according to claim 1 further comprising an axle for pivotally connecting the lever to the post.

3. The stepper according to claim 1 further comprising two sleeves each connected to a related one of the pedals and rotationally supported on a related one of the axles.

4. The stepper according to claim 1, wherein each of the impeding elements is selected from a group consisting of a spring, a pneumatic cylinder and a hydraulic cylinder.

5. The stepper according to claim 1 further comprising two elastic strings connected to the base so that such a user can exercise the user's arms by pulling the elastic strings.

6. The stepper according to claim 1, wherein each of the pedals comprises an arched portion for contact with a related one of the ends of the lever.

* * * * *